US009099267B2

(12) United States Patent
Ardyna et al.

(10) Patent No.: US 9,099,267 B2
(45) Date of Patent: Aug. 4, 2015

(54) HYBRID CIRCUIT BREAKER HAVING A SWITCH WITH RETURN ON CLOSURE

(75) Inventors: Henry Ardyna, Eveux (FR); Gwenaël Marquezin, Villeurbanne (FR)

(73) Assignee: ALSTOM TECHNOLOGY LTD. (CH)

( * ) Notice: Subject to any disclaimer, the term of this patent is extended or adjusted under 35 U.S.C. 154(b) by 320 days.

(21) Appl. No.: 13/583,543

(22) PCT Filed: Mar. 8, 2011

(86) PCT No.: PCT/EP2011/053472

§ 371 (c)(1),
(2), (4) Date: Feb. 25, 2013

(87) PCT Pub. No.: WO2011/110561

PCT Pub. Date: Sep. 15, 2011

(65) Prior Publication Data

US 2013/0233831 A1 Sep. 12, 2013

(30) Foreign Application Priority Data

Mar. 9, 2010 (FR) ..... 10 51679

(51) Int. Cl.
*H01H 33/666* (2006.01)
*H01H 31/00* (2006.01)
*H01H 33/12* (2006.01)

(52) U.S. Cl.
CPC ..... *H01H 33/6661* (2013.01); *H01H 31/003* (2013.01); *H01H 33/126* (2013.01)

(58) Field of Classification Search
CPC ..... H01H 33/143; H01H 33/6661; H01H 33/126; H01H 33/70; H01H 33/90; H01H 31/003; H01H 9/40; H01H 2033/028
USPC ..... 361/115, 120; 218/3, 4, 7, 70, 154, 2
See application file for complete search history.

(56) References Cited

U.S. PATENT DOCUMENTS

| | | | | |
|---|---|---|---|---|
| 3,560,682 | A * | 2/1971 | Kohler et al. | 218/10 |
| 4,168,417 | A | 9/1979 | Puetz et al. | |
| 4,538,039 | A * | 8/1985 | Gotoh et al. | 218/3 |
| 7,199,324 | B2 * | 4/2007 | Perret | 218/3 |
| 7,426,100 | B2 * | 9/2008 | Neveu et al. | 361/115 |
| 2006/0091112 | A1 | 5/2006 | Neveu et al. | |

FOREIGN PATENT DOCUMENTS

| | | |
|---|---|---|
| DE | 3528770 | 8/1985 |
| DE | 3528770 | 2/1987 |
| EP | 1653491 | 10/2005 |
| EP | 1653491 A2 | 5/2006 |
| EP | 1653491 A3 | 8/2007 |
| FR | 2744284 | 1/1996 |

* cited by examiner

*Primary Examiner* — Truc Nguyen
*Assistant Examiner* — William Bolton
(74) *Attorney, Agent, or Firm* — Baker & Hostetler LLP

(57) ABSTRACT

A hybrid circuit breaker for use in the field of medium and high-voltage hybrid circuit breakers comprising an arc-control device (110), a vacuum switch (20) and a single mechanical control apparatus for controlling the opening and closing of the vacuum switch (20) with the control apparatus comprising a control rod (31) for controlling the movement of a movable contact (22) relative to a stationary contact with the movable contact secured to a movable control rod (32), via a holding system including a flexible toroidal helical spring (38) placed in a groove of the movable contact and in a groove located in the movable control rod and further comprising an energy accumulation system including a spring (34) for causing the flexible toroidal helical spring (38) to release the movable control rod from the movable contact and cause the movable contact to make contact with the stationary contact.

5 Claims, 3 Drawing Sheets

HYBRID CIRCUIT BREAKER HAVING A SWITCH WITH RETURN ON CLOSURE

TECHNICAL FIELD

The invention relates to the field of high- and medium-voltage hybrid circuit breakers having an arc-control device and a vacuum switch in which the movable contacts are actuated by a single control. In particular, the invention relates to a mechanical control that enables the arc-control device and the vacuum switch to open simultaneously, followed by early closing of the vacuum switch prior to the arc-control device being put back into operation.

PRIOR ART AND PROBLEMS POSED

In that type of hybrid circuit breaker, a single mechanical arrangement controls the movements of the movable contacts of each of the switches, which contacts follows its own movement profile over time. That makes it possible, among other things, to protect the vacuum switch while the arc-control device is opening.

With reference to FIG. 1, such a hybrid circuit breaker is known from patent document EP 1 653 491 A2, said circuit breaker having an arc-control device 10 defining a longitudinal axis A, A' and, placed perpendicularly thereto, a vacuum switch 20 controlled by the same mechanical mechanism. Control of the assembly is performed by mechanical elements (most of which are not shown) operating along the longitudinal axis A, A' of the arc-control device 10. In one of the embodiments of those mechanical control elements, there is a sliding plate 154 that acts on a wheel 155 that is mounted to turn at the end of a rod 152, said rod being secured to a control rod 23 carrying the movable contact 22 of the vacuum switch 20. A sloping surface of the sliding plate 154 serves to actuate the control rod 23 of the vacuum switch in order to separate the movable contact 22 from the stationary contact 21 of the vacuum switch 20, at a moment that is determined relative to the opening of the arc-control device 10 in a determined timing sequence that is defined in the description of document EP 1 653 491.

More precisely, in that type of system, when the control mechanism, moves along the longitudinal axis A, A' of the arc-control device 10, besides operating the opening mechanism of the arc-control device 10, that movement causes the vacuum switch 20 to open. Under the action of the sliding plate 154, the control rod 23 of the vacuum switch moves, by means of the wheel 155. Once the wheel 155 has reached the end ramp 140 of the sliding plate 55, extending parallel to the longitudinal axis A, A', the control rod 23 of the vacuum switch 20 is urged, in part by a spring 138, to return to an initial position in which the stationary and movable contacts 21, 22 are put back into contact inside the vacuum switch 20. Another cycle may then be effected.

It is pointed out that, in FIG. 1, the representation of certain elements has been simplified, and this is true in particular for the stationary and movable contacts 21, 22 of the vacuum switch 20.

However, that type of mechanical control requires numerous stationary and movable mechanical elements, which requires a large amount of machining.

The object of the invention is to avoid those drawbacks that, result from the complexity of the mechanical system and from its manufacturing cost.

SUMMARY OF THE INVENTION

To this end, the main object of the invention is a hybrid circuit breaker comprising:

a first switch comprising a first pair of contacts in which a movable contact can be moved with regard to a first contact along a first longitudinal axis between a closed position and an open position;

a second switch comprising a second pair of contacts in which a movable contact, secured to a rod of a movable contact, is movable along a second axis between a closed position and an open position, by me axis of a control rod; and actuator means providing to a single control action to move the movable contacts relative to the stationary contacts between a closed position and an open position, the actuator means being adapted to open the first and second pairs of contacts and then to re-close the second pair of contacts while holding the first pair open for a determined length of time.

According to the invention, the hybrid circuit breaker has a holding system for holding the control rod of the second switch and an energy accumulation system pressing against the movable contact rod and relative to a fixed point and being designed to be loaded up to a certain value at which the holding system deforms under the force and separates the control rod from the movable contact rod and enables the movable contact to return towards the stationary contact.

In a first embodiment of the invention, the holding system for holding the control rod is a flexible toroidal helical spring placed in a groove of the movable contact rod and in a groove of a control rod of the second switch and an energy accumulation system pressing against the movable contact rod relative to a fixed point, and being designed to be loaded up to a certain value at which the flexible toroidal helical spring deforms under the force and releases the control rod from the movable contact rod and enables the movable contact to return towards the stationary contact.

In a second embodiment of the holding system for the control rod, the system comprises both a ball thrust outwards from a radial non-through hole in the movable contact rod by a spring placed inside said hole and a corresponding notch made in the inside surface of an end of the control rod, said end having a length that is greater than the stroke of the movable contact rod in the end of the control rod so that the ball does not escape from said end.

In a first embodiment of the circuit breaker of the invention the first switch is an arc-control device in which there is a control groove having a sloping portion between two portions parallel to the longitudinal axis A, A', which sloping portion is designed to constitute a control ramp for the control rod of the second switch that is a vacuum switch, by longitudinal movement of the groove along the longitudinal axis A, A'.

In a second embodiment, the first switch is an arc-control device placed along a longitudinal axis C, C' parallel to the second longitudinal axis of the second switch that is a vacuum switch. In this event, the control rod of the vacuum switch has a perpendicular portion with its end mounted to slide in a longitudinal groove of the arc-control device.

LIST OF FIGURES

The invention and its various technical characteristics can be better understood on reading the following description. The description is accompanied by several figures in which, respectively:

DETAILED DESCRIPTION OF TWO EMBODIMENTS OF THE INVENTION

Figure 1:
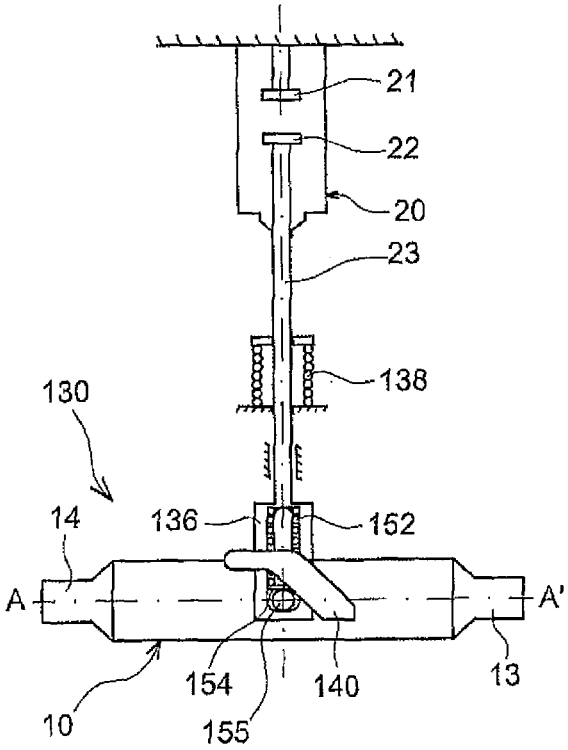
FIG. 1 (PRIOR ART)
FIG. 1 shows a prior art hybrid circuit breaker.
Figure 2:
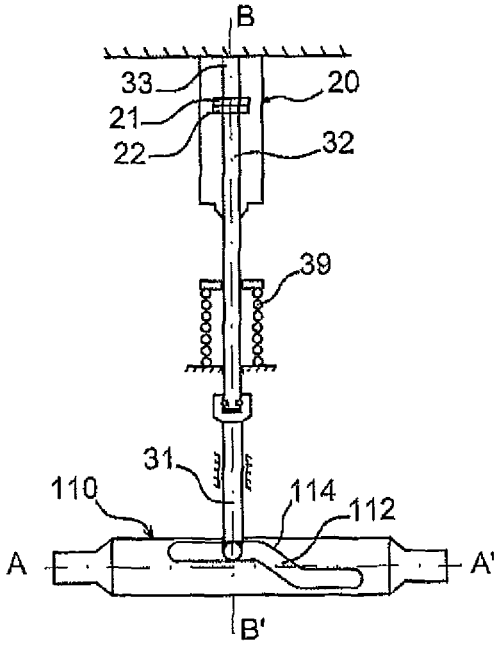
FIG. 2 shows a first embodiment of the hybrid circuit breaker of the invention.

With reference to FIG. 2, the invention provides for use of a switch system in a hybrid circuit breaker such as defined in European patent application EP 1 653 491 in order to actuate the movable contacts 21 and 22 of the vacuum switch 20. Such an actuator device makes it possible to implement the following sequences:

- opening command for a first switch, which in this example is the arc-control device 110;
- delay opening of the second switch, which in this example is the vacuum switch 20, so as to enable the arc-control device 110 contact to separate at a minimum speed and synchronously with the movable 22 and stationary 21 contacts of the vacuum switch 20; and
- closing of the vacuum switch 20, while holding the arc-control device 110 in the open position.

More precisely, this makes it possible to open the vacuum switch 20 and then to re-close it, under the effect of a spring 39, while continuing the stroke of a control rod 31. The spring 39 performs the role of an energy accumulation system. In this system, the control rod 31 pulls the movable contact 22 of the vacuum switch 20, via a flexible toroidal helical spring 38 that temporarily holds together the control rod 31 and a movable contact rod 32 having its end fastened to the movable contact 22. Simultaneously, the spring 39 is compressed until the moment when the flexible toroidal helical spring 38 gives way in compression, thus releasing the movable contact rod 32, which closes under the action of the spring 39.

Such an arrangement makes it possible, while having a relatively large stroke for the control rod 31, to avoid moving the movable contact 22 too far apart from the stationary contact 21 of the vacuum switch 20. In other words, the movable contact 22 returns towards the movable contact 21, while the control rod 31, continues its stroke, being actuated by the mechanical actuator system of the vacuum switch 20 and or the arc-control device 110.

Figure 3:
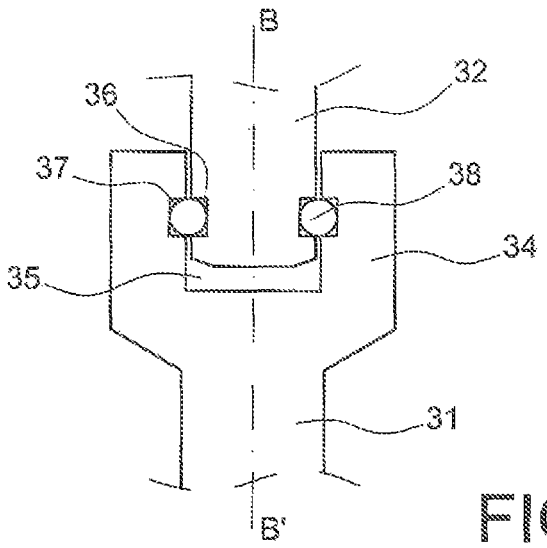
FIG. 3 is a cross-section showing a first variant of a detail of the hybrid circuit breaker of the invention.

FIG. 3 shows in detail a first variant of the connection between the control rod 31 and the movable contact rod 32 for opening and closing the vacuum switch, as described above. The top end 34 of the control rod 31 has an enlarged and hollow shape. The inside space 35 thus defined has an inside diameter that is very slightly greater than the outside diameter of the movable contact rod 32. Said movable contact has a groove 36 in its perimeter and the top end 34 of the control rod 31 has, in its inside surface, a like groove 37 corresponding to the groove 36 of the control rod 32. These two grooves 36 and 37 define a radial space in which a flexible toroidal helical spring 38 is placed.

It should be understood that, if the control rod 31 is urged with sufficient force towards the bottom, of FIG. 3, the flexible toroidal helical spring 38 will release upon reaching a certain value of the stress applied by the control rod 31. The flexible toroidal helical spring 38 thus deforms in compression and makes it possible to separate the movable contact rod 32 from the control rod 31.

Figure 4:
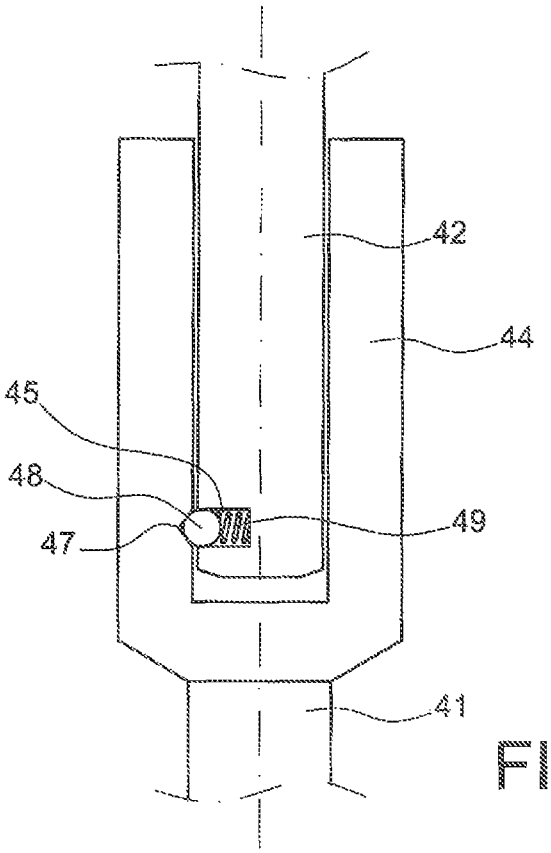
FIG. 4 is a cross-section showing a second variant of the same detail of the hybrid circuit breaker of the invention.

With reference to FIG. 4, a second variant of the connection between the control rod 41 and the movable contact rod 42 uses a ball 48 pushed by a spring 49, said spring being housed in a radial non-through hole 45 made in the movable contact rod 42, towards its end and facing the control rod 41. Correspondingly, the inside surface of the end 44 of the control rod 41, which is thus of elongate tubular shape, has a notch 47 corresponding to the position of the ball 48, when the control rod 41 and the movable contact rod 42 are held together. The ball 48 therefore projects beyond the outside surface of the movable contact rod 42 and is received in the notch 47 in the end 44 of the control rod 41.

When the traction supplied by the spring 39 (FIG. 2) is increased, the ball 48 is pushed back inside the hole 45 by pressing against the spring 49. The movable contact rod 42 therefore tends to move out from the end 44 of the control rod 41 by sliding inside it, but without the ball 48 coming out of the end 44. Consequently, the length of the end 44 of the control rod 41 is much greater than the design stroke between the two relative positions of the control rod 41 and of the movable contact rod 42.

The automatic system for temporary release of the movable contact rod relative to the control rod of the vacuum switch as described above makes it possible to envisage other hybrid circuit breaker architectures.

Figure 5:
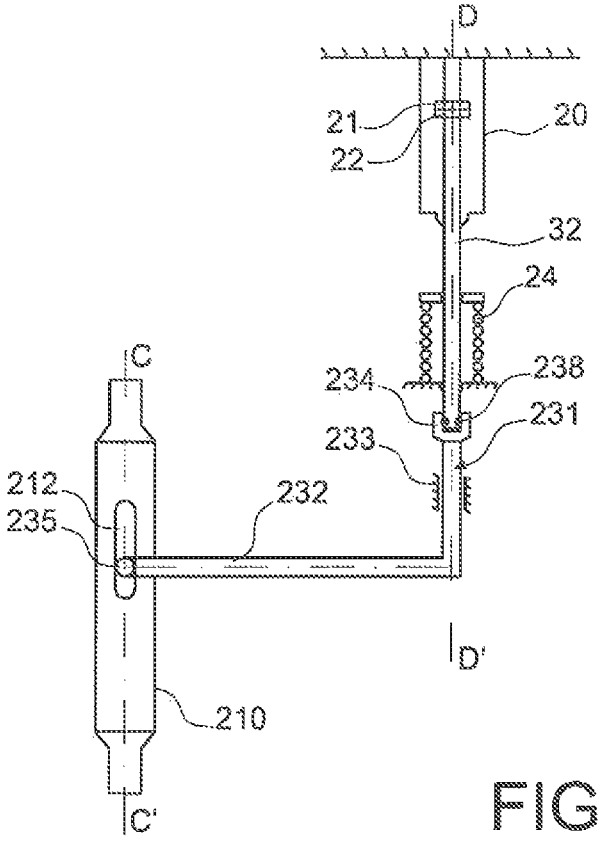
FIG. 5 shows a second embodiment of the hybrid circuit breaker of the invention.

With reference to FIG. 5, it is possible to envisage using a vacuum switch 20 defining a longitudinal axis D, D' that is parallel to the longitudinal axis C, C' of the corresponding arc-control device 210. This embodiment has the same main elements, namely the vacuum switch 20, the energy accumulation spring 24, the control rod 231 with its top end 234 secured to the movable contact rod 32 by a flexible toroidal helical spring 238, the bottom portion of the control rod 231 having a perpendicular portion 232 ending in an end 235 that is mounted to slide in a longitudinal slot 212 of the arc-control device 210. A bearing 233 is shown around the control rod 231 to show that the rod is guided in longitudinal translation along the longitudinal axis D, D'. In this example also, the single mechanical device has been simplified, since, in the arc-control device 210, it need only drive the end 235 of the perpendicular portion 232 of the control rod 231. The timing sequence of the respective openings of the arc-control device 210 and of the vacuum switch 20 may therefore be the same as the sequence described above and in patent document EP 1 653 491 A2.

The invention claimed is:

1. A hybrid circuit breaker comprising:

a first switch comprising a first pair of contacts in which a movable contact can be moved along a first longitudinal axis (A, A'; C, C') between a closed position and an open position;

a second switch comprising a second pair of contacts in which a movable contact (22), secured to a rod (32, 42) of a movable contact, is movable along a second axis (B, B'; D, D') between a closed position and an open position, by means of a control rod (31, 41, 231); and actuator means providing to a single control action to move the movable contacts relative to the stationary contacts between a closed position and an open position, the actuator means being adapted to open the first and second pairs of contacts and then to re-close the second pair of contacts while holding the first pair open for a determined length of time;

the circuit breaker being characterized in that it has a holding system for coupling the control rod (31, 41, 231) of the second switch to the movable contact rod (32, 42) with the holding system comprising a spring (38, 238) and an energy accumulation system pressing against the movable contact rod (32, 42) and relative to a fixed point and being designed to be loaded up to a certain value to cause the spring in the holding system to deform under the force applied by the control rod for separating, the control rod (31, 41, 231) from the movable contact rod (32, 42) to enable the movable contact (22) to return towards the stationary contact (21).

2. A hybrid circuit breaker according to claim 1, characterized in that the spring in the holding system of the control rod (31, 231) is a flexible toroidal helical spring (38, 238) placed in a groove (35) of the movable contact rod (32) and a groove (37) on an inside surface of the control rod (31, 231) of the second switch for releasing the control rod (31, 231) from the movable contact rod (32) to enable the movable contact (22) to return towards the stationary contact (21).

3. A hybrid circuit breaker according to claim 1, wherein the holding system for the control rod (41) further comprises a ball (48) thrust outwards from a radial non-through hole (45) in the movable contact rod (42) by a spring (49) placed inside said hole and a corresponding notch (47) made in the inside surface of an end (44) of the control rod (41), said end (44) having a length that is greater than the stroke of the movable contact rod (42) in the end (44) of the control rod (41) so that the ball (48) does not escape from said end (44).

4. A hybrid circuit breaker according to claim 1, characterized in that the first switch is an arc-control device (110) in which there is a control groove (112) having a sloping portion (114) between two portions parallel to the longitudinal axis (A, A') of this arc-control device (110), which sloping portion (114) is designed to constitute a control ramp for the control rod (31, 41) of the second switch that is a vacuum switch (20) by longitudinal movement of the end of the control rod (31, 41) in the groove (112), along the longitudinal axis (A, A') of the arc-control device (110).

5. A hybrid circuit breaker according to claim 1, being characterized in that the first switch is an arc-control device (210) placed along a longitudinal axis (C, C') parallel to the second longitudinal axis (D, D') of the second switch that is a vacuum switch (20), the control rod (231) of the vacuum switch (20) having a perpendicular portion (232) with its end mounted to slide in a longitudinal groove (212) of the arc-control device (210).

* * * * *